US010072481B2

(12) United States Patent
Bordoloi et al.

(10) Patent No.: US 10,072,481 B2
(45) Date of Patent: Sep. 11, 2018

(54) MODELING AND PRODUCTION OF TIGHT HYDROCARBON RESERVOIRS

(71) Applicant: Baker Hughes Incorporated, Houston, TX (US)

(72) Inventors: Sanjeev Bordoloi, Houston, TX (US); Namsu Park, Houston, TX (US); Christopher David Ward, London (GB)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 919 days.

(21) Appl. No.: 14/013,207

(22) Filed: Aug. 29, 2013

(65) Prior Publication Data

US 2015/0060054 A1 Mar. 5, 2015

(51) Int. Cl.

| | |
|---|---|
| ***G06G 7/48*** | (2006.01) |
| ***E21B 43/00*** | (2006.01) |
| ***E21B 49/00*** | (2006.01) |

(52) U.S. Cl.

CPC ..... *E21B 43/00* (2013.01); *E21B 49/003* (2013.01)

(58) Field of Classification Search

CPC ..... E21B 43/00; E21B 49/003

USPC ..... 703/10

See application file for complete search history.

(56) References Cited

U.S. PATENT DOCUMENTS

| | | | | |
|---|---|---|---|---|
| 4,887,464 | A * | 12/1989 | Tannenbaum | E21B 21/08 175/206 |
| 5,415,030 | A | 5/1995 | Jogi et al. | |
| 6,290,000 | B1 * | 9/2001 | Zamfes | E21B 49/003 175/50 |
| 2008/0029306 | A1 | 2/2008 | Krueger | |
| 2010/0235154 | A1 * | 9/2010 | Meurer | G01V 11/00 703/10 |
| 2011/0139464 | A1 * | 6/2011 | Henderson | E21B 21/01 166/370 |
| 2013/0066558 | A1 | 3/2013 | Wessling et al. | |

* cited by examiner

*Primary Examiner* — Saif A Alhija

(74) *Attorney, Agent, or Firm* — Mossman, Kumar & Tyler, PC

(57) ABSTRACT

Methods for modeling a tight hydrocarbon reservoir intersected by a borehole. Methods include using an estimated hydrocarbons-in-place value for the tight hydrocarbon reservoir and a gas parameter associated with drilling the borehole to create a drilling model. The model may determine an operation of a well control device associated with the borehole; or correlate the hydrocarbons-in-place value with the gas parameter for the tight hydrocarbon reservoir. Other methods include determining, during the forming of the borehole, an operation of a well control device associated with the borehole using an estimated hydrocarbons-in-place for the tight hydrocarbon reservoir and a gas parameter. The gas parameter may comprise a detected gas parameter normalized using at least one corresponding drilling parameter. Further methods include employing the model for performing operations in another borehole drilled in the same reservoir. Further methods include using the model to estimate a second hydrocarbons-in-place value in the other borehole.

22 Claims, 5 Drawing Sheets

MODELING AND PRODUCTION OF TIGHT HYDROCARBON RESERVOIRS

FIELD OF THE DISCLOSURE

In one aspect, this disclosure relates generally to modeling and production of reservoirs. More particularly, this disclosure relates to methods, devices, and systems for modeling and production of tight hydrocarbon reservoirs.

BACKGROUND OF THE DISCLOSURE

Geologic formations are used for many purposes such as hydrocarbon production, geothermal production and carbon dioxide sequestration. Boreholes are typically drilled into the earth in order to intersect and access the formations. Prior to a borehole being drilled, forces or loads in the rock mass of a formation are in equilibrium (e.g., "static equilibrium" of the formation). When the borehole is drilled, the loads must be evenly distributed to adjacent rock and materials in order to keep the formation in static equilibrium. Keeping the drilled formation stable generally requires a support pressure applied via drilling mud in the borehole. The proper support pressure is related to the pressure of the formation fluid in the pores of the formation (i.e., pore pressure). If the applied support pressure is insufficient, the formation surrounding the borehole may become unstable and collapse into the borehole. However, if more pressure is applied than needed, drilling may be unnecessarily slowed.

SUMMARY OF THE DISCLOSURE

In aspects, the present disclosure is related to methods of modeling a tight hydrocarbon reservoir intersected by a borehole. Methods may include using an estimated hydrocarbons-in-place value for the tight hydrocarbon reservoir and a gas parameter associated with drilling the borehole to create a drilling model. The drilling model may determine an operation of a well control device associated with the borehole. The model may correlate the hydrocarbons-in-place value with the gas parameter for the tight hydrocarbon reservoir. The gas parameter may comprise a detected gas parameter normalized using at least one corresponding drilling parameter. The drilling model may determine the presence of an underbalanced condition of the borehole in dependence upon a current hydrocarbons-in-place value and a current gas parameter. The method may include estimating a pore pressure associated with the tight hydrocarbon reservoir using the gas parameter. The drilling model may determine the presence of an underbalanced condition of the borehole in dependence upon a current hydrocarbons-in-place value and at least one of: i) the gas parameter; and ii) the estimated pore pressure. The method may include correlating a peak in the detected gas parameter with nominal drilling conditions using the hydrocarbons-in-place value.

The detected gas parameter may be determined from gas information detected using a sensor associated with the borehole during drilling. The gas parameter may comprise the detected gas parameter normalized using at least one of: i) rate of penetration; ii) bit diameter; iii) borehole diameter; and iv) pump rate. The gas parameter may comprise the detected gas parameter normalized using the formula:

$$GN=G\cdot(ROPN/ROP)\cdot(DN/D)2\cdot(Q/QN)\cdot(1/E),$$

where GN is normalized gas units, G is measured gas units, ROPN is reference rate of penetration, ROP is actual rate of penetration, DN is reference bit diameter, D is actual hole diameter, QN is reference pump rate, Q is actual pump rate, and E is gas system efficiency.

The detected gas parameter may comprise a parameter in a wellbore during drilling, the parameter comprising at least one of i) a rate of gas production; and ii) a gas pressure.

The method may include estimating hydrocarbons-in-place; normalizing the detected gas parameter using the drilling parameter; or deriving the estimated hydrocarbons-in-place using the gas parameter. The method may include correlating an absence of kick with at least one of: i) a decreasing normalized gas trend or ii) an increasing hydrocarbons-in-place trend; and/or correlating kick with at least one of: i) an increasing normalized gas trend or ii) a decreasing hydrocarbons-in-place trend. The method may further include operating the well control device according to the drilling model.

Other method embodiments may include producing a hydrocarbon from a tight hydrocarbon reservoir, including forming a borehole intersecting the tight hydrocarbon reservoir; determining, in real-time during the forming of the borehole, an operation of a well control device associated with the borehole using an estimated hydrocarbons-in-place for the tight hydrocarbon reservoir and a gas parameter, the gas parameter comprising a detected gas parameter normalized using a drilling parameter associated with the drilling operation; and operating the well control device according to the determination. Methods may include using the estimated hydrocarbons-in-place value and the gas parameter to determine the mud weight. Operating the well control device may include leaving the well control device untriggered. Other method embodiments may include employing a drilling model created as above for performing operations in another borehole drilled in the same reservoir. Wherein the model correlates the hydrocarbons-in-place value with the gas parameter for the tight hydrocarbon reservoir, embodiments may include using the model to estimate a second hydrocarbons-in-place value in the another borehole.

Embodiments according to the present disclosure may include apparatus for modeling a tight hydrocarbon reservoir intersected by a borehole, comprising: a processor; a non-transitory computer-readable medium; and a program stored by the non-transitory computer-readable medium comprising instructions that, when executed, cause the processor to perform a method of modeling a tight hydrocarbon reservoir as described herein.

Example features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
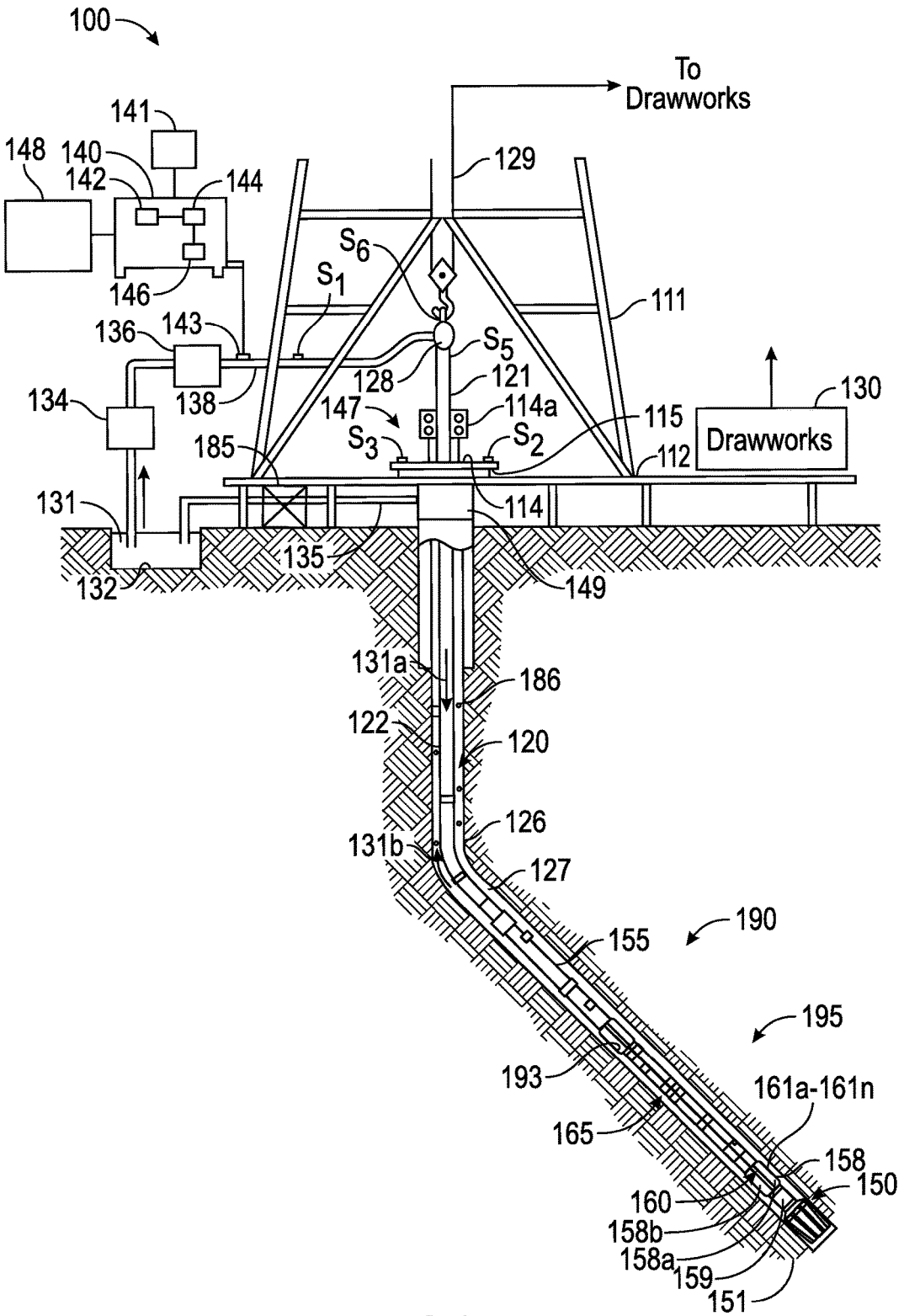
FIG. 1 is a schematic diagram of an exemplary drilling system 100 according to one embodiment of the disclosure.

Aspects of the present disclosure relate to modeling tight hydrocarbon formations using normalized gas parameters and/or hydrocarbons-in-place. Other aspects relate to production of such formations, including drilling and well control. These formations may include reservoirs of gas, oil, and/or condensate. Modeling may include estimation of pore pressure in tight hydrocarbon formations.

During establishment or servicing of a hydrocarbon producing well, undesirable conditions may occur which may be hazardous to equipment and personnel. For example, during drilling, high pressure formation fluid can invade the wellbore and displace drilling fluid from the well. This undesirable condition is known in the industry as a "kick." The resulting pressure interaction in the wellbore may lead to an uncontrolled flow of fluids from a well, known as a "blow-out." Thus, conventionally, the mud weight of a drilling fluid circulated in the well during drilling may be selected to provide an appropriate hydrostatic pressure that minimizes the risk and impact of a "kick." During drilling, the pressure of the drilling mud may be maintained within a pressure window by a mud program using pore pressure information. Accurately determining the pressure window enables efficient drilling of the borehole while preventing damage.

Additionally, well control devices (e.g., surface blowout prevention systems or hydraulic isolation devices) may be used to protect against blowouts. When a kick is detected, a well control device may be activated to "shut-in" a well to seal off and/or exert control over the kick. This may be followed by circulating heavy mud through the choke to balance the kick pressure before the well control device is disengaged.

This process is expensive and time consuming, and interrupts more beneficial activities in the wellbore. Avoiding the unnecessary activation of a well control device (or system of well-control devices) is therefore desirable. Activating a well control device when required to prevent a blowout is also desirable. Thus, accurately determining the presence or absence of a kick is beneficial to enable efficient drilling of the borehole while preventing damage.

Both kick detection and kick prevention (e.g., via mud program operation, drilling operation, etc.) may be carried out using an estimated pore pressure of the formation. However, reliable pore pressure estimation in tight hydrocarbon formations may be challenging. Tight hydrocarbon formations may include petroleum-bearing formations of low permeability, such as, for example, tight shales, shaley limestone, clays, or tight sandstone. Difficulties in pore pressure estimation in tight formations may arise from the unavailability of direct pressure measurements, unpredictable relationships between petrophysical log data and pore pressure, unavailability of sufficient datasets for wells in terms of multiple logs and dependable stratigraphic correlation, and so on. These issues may be compounded in deviated wellbores, which may also lack sufficient data (e.g., petrophysical log data) for accurate hydrocarbons-in-place estimates. For these and other reasons, drillers often rely on gas parameters (e.g., gas counts) detected during drilling to estimate pore pressure. These gas parameters may be correlated with a developing underbalanced condition which may lead to a kick or to other undesirable effects on the drilling system.

However, in tight hydrocarbon formations gas data also has deficiencies as an indicator of pore pressure. The behavior of tight hydrocarbon formations may be unpredictable according to historical models. Shale, for example, is too tight to allow hydrocarbons to flow, which limits the value of reported connection gases and the overall drilled gas trends as reliable indicators for pore pressure. Moreover, gas released from source rock in the formation by the rock's decomposition during drilling may contribute to the detected gas. This 'liberated gas' may be considered as hydrocarbons-in-place unleashed from the source rock, and is distinct from gas as part of formation fluids flowing into the wellbore (e.g., a kick), which may stem from a pressure in the wellbore lower than the formation pressure. While a kick may indicate a potentially dangerous underbalanced borehole condition which may necessitate a change in mud weight, liberated gas results from processes which generally may be considered benign.

In the case of shale, for example, detected gas may depend significantly on the liberated gas from the source rock. Variations in background gas during drilling are thus significantly influenced by the hydrocarbons-in-place in the rock of the formation and may be correlated with variations in drilling parameters (e.g., hole size, rate of penetration, etc.). Therefore, adjusting gas parameters or modifying the estimated pore pressure to account for liberated gas may provide more accurate estimation of pore pressure in such formations.

Example gas parameters may be estimated according to methods known in the art, using a variety of sensors. The sensors may provide information relating to a geological parameter, a geophysical parameter, a petrophysical parameter, and/or a lithological parameter. Example sensors may include pressure sensors on the drill string, elsewhere in the borehole or at the surface. Other examples may include formation evaluation sensors such as resistivity sensors, nuclear magnetic resonance (NMR) sensors, gamma ray detectors, and other sensors. Thus, sensors may include sensors for estimating formation resistivity, dielectric constant, acoustic porosity, bed boundary, formation density, nuclear porosity and certain rock characteristics, permeability, capillary pressure, and relative permeability. It should be understood that this list is illustrative and not exhaustive.

Aspects of the present disclosure include normalizing gas information obtained during drilling using various drilling parameters to remove operational artifacts. The predictive workflow may include normalization of the background gas with drilling parameters such as hole size, rate of penetration (ROP), and so on to determine a more reliable correlation between the recorded gas trend. The normalized gas parameter may provide a better baseline for identifying flow, connection, ballooning and caving gas conditions or the like. Further normalization of the reported gas trend (which may already be standardized for drilling related factors) may then carried out with hydrocarbon-in-place data, which may lead to a more reliable quantitative estimation of likely overpressure in the shale plays using the drilled gas information.

General embodiments of the present disclosure include methods, devices, and systems for modeling a tight gas reservoir intersected by a borehole. Modeling the tight gas reservoir may include estimating an effect on a gas parameter attributable to liberated gas. This effect may be used in estimating a pore pressure of the formation. A method for modeling the tight gas reservoir may include using an estimated hydrocarbons-in-place value for the tight hydrocarbon reservoir and a normalized gas parameter to create a drilling model determining an operation of a well control device associated with the borehole. Further embodiments may include applying the model to operations in the same borehole or in other boreholes in the same or like formations.

FIG. 1 is a schematic diagram of an exemplary drilling system 100 according to one embodiment of the disclosure. FIG. 1 shows a drill string 120 that includes a drilling assembly or bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drilling assembly 190, attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor S1 in line 138 provides information about the fluid flow rate. A surface torque sensor S2 and a sensor S3 associated with the drill string 120 respectively provide information about the torque and the rotational speed of the drill string 120. Tubing injection speed is determined from the sensor S5, while the sensor S6 provides the hook load of the drill string 120.

Well control system 147 is placed at the top end of the borehole 126. The well control system 147 includes a surface blow-out-preventer (BOP) stack 115 and a surface choke 149 in communication with a wellbore annulus 127. The surface choke 149 can control the flow of fluid out of the borehole 126 to provide a back pressure as needed to control the well.

In some applications, the drill bit 150 is rotated by only rotating the drill pipe 122. However, in many other applications, a downhole motor 155 (mud motor) disposed in the drilling assembly 190 also rotates the drill bit 150. The rate of penetration (ROP) for a given BHA largely depends on the WOB or the thrust force on the drill bit 150 and its rotational speed.

A surface control unit or controller 140 receives signals from the downhole sensors and devices via a sensor 143 placed in the fluid line 138 and signals from sensors S1-S6 and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include a variety of other sensors and devices 159 for determining one or more properties of the BHA 190 (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159.

The BHA 190 may include a steering apparatus or tool 158 for steering the drill bit 150 along a desired drilling path. In one aspect, the steering apparatus may include a steering unit 160, having a number of force application members 161*a*-161*n*. The force application members may be mounted directly on the drill string, or they may be at least partially integrated into the drilling motor. In another aspect, the force application members may be mounted on a sleeve, which is rotatable about the center axis of the drill string. The force application members may be activated using electro-mechanical, electro-hydraulic or mud-hydraulic actuators. In yet another embodiment the steering apparatus may include a steering unit 158 having a bent sub and a first steering device 158*a* to orient the bent sub in the wellbore and the second steering device 158*b* to maintain the bent sub along a selected drilling direction. The steering unit 158, 160 may include near-bit inclinometers and magnetometers.

The drilling system 100 may include sensors, circuitry and processing software and algorithms for providing information about desired drilling parameters relating to the BHA, drill string, the drill bit and downhole equipment such as a drilling motor, steering unit, thrusters, etc. Many current drilling systems, especially for drilling highly deviated and horizontal wellbores, utilize coiled-tubing for conveying the drilling assembly downhole. In such applications a thruster may be deployed in the drill string 190 to provide the required force on the drill bit.

Exemplary sensors for determining drilling parameters include, but are not limited to drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling, and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT, a downhole measurement system, manufactured by BAKER HUGHES INCORPORATED.

The drilling system 100 can include one or more downhole processors at a suitable location such as 193 on the BHA 190. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 142 can process the surface measured data, along with the data transmitted from the downhole processor, to evaluate formation lithology. While a drill string 120 is shown as a conveyance device for sensors 165, it should be understood that embodiments of the present disclosure may be used in connection with tools conveyed via rigid (e.g. jointed tubular or coiled tubing) as well as non-rigid (e.g. wireline, slickline, e-line, etc.) conveyance systems. The drilling system 100 may include a bottomhole assembly and/or sensors and equipment for implementation of embodiments of the present disclosure on either a drill string or a wireline.

A point of novelty of the system illustrated in FIG. 1 is that the surface processor 142 and/or the downhole processor 193 are configured to perform certain methods (discussed below) that are not in the prior art. Surface processor 142 or downhole processor 193 may be configured to control mud pump 134 and/or well control system 147. Control of the mud pump 134 and/or well control system 147 may be carried using a model or drilling plan created using methods described below. For example, surface processor 142 or downhole processor 193 may be configured to activate well control system 147, either autonomously upon triggering conditions, in response to operator commands, or combinations of these. Conversely, the processors may leave components of the well control system 147 untriggered upon determination that triggering conditions are not present. Control of these devices, and of the various processes of the drilling system generally, may be carried out in a completely automated fashion or through interaction with personnel via notifications, graphical representations, user interfaces and the like. Additionally or alternatively, surface processor or downhole processor may be configured for the creation of the model or drilling plan. Reference information accessible to the processor may also be used.

As described above, gas information in tight hydrocarbon formations may deviate from historical models with respect to pore pressure. However, gas parameters normalized with respect to drilling parameters may be more reliably correlated to pore pressure.

Figure 2A:
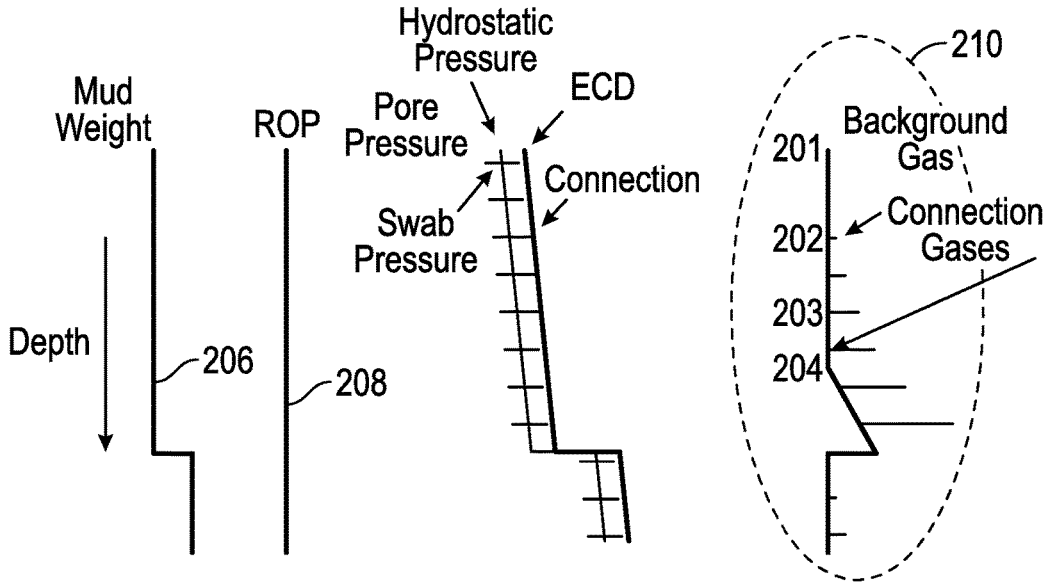
FIGS. 2A and 2B show diagrams illustrating the effect of ROP on a normalized versus a non-normalized gas parameter.
Figure 2B:
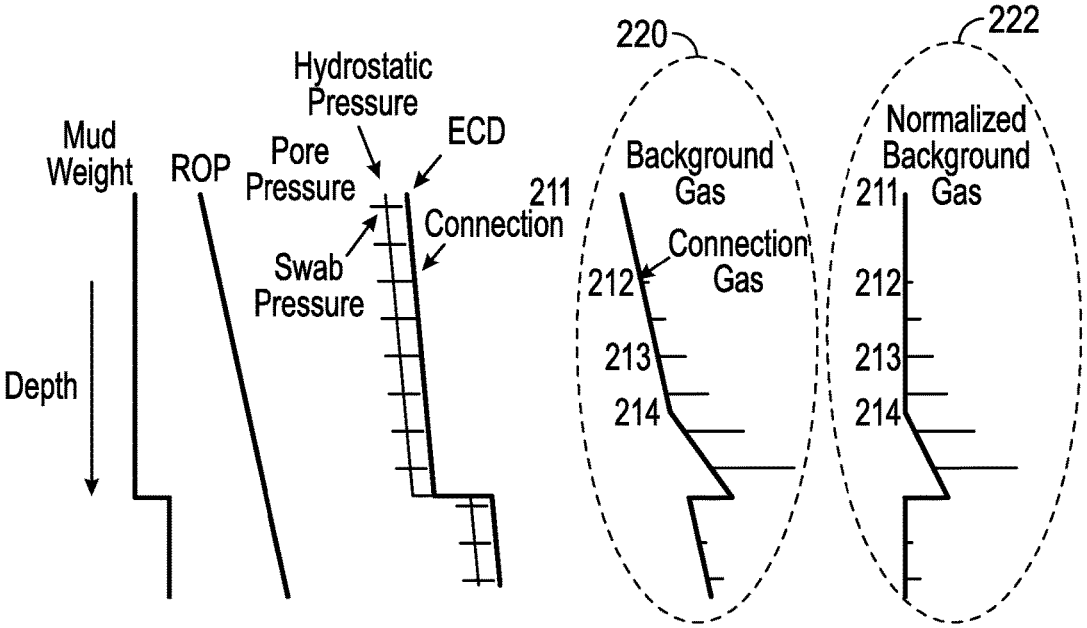

FIGS. 2A and 2B show diagrams illustrating the effect of ROP on a normalized versus a non-normalized gas parameter (gas count). Mud weight 206, 216, ROP 208, 218 and detected gas 210, 220 are shown with respect to depth. Selected depth intervals 201-204 and 211-214 are shown for convenience. In FIG. 2A, it is apparent that a constant ROP 208 facilitates the identification of pressure anomalies using background gas interpretation. The development of an under-balanced state may be readily identified proximate to point 204. In FIG. 2B, an increasing ROP trend increases the difficulty of interpretation. The non-normalized gas count 220 indicates the development of an under-balanced state beginning at point 212. However, using normalized gas counts 222, it is seen that the well is not underbalanced before point 214.

Figure 3:
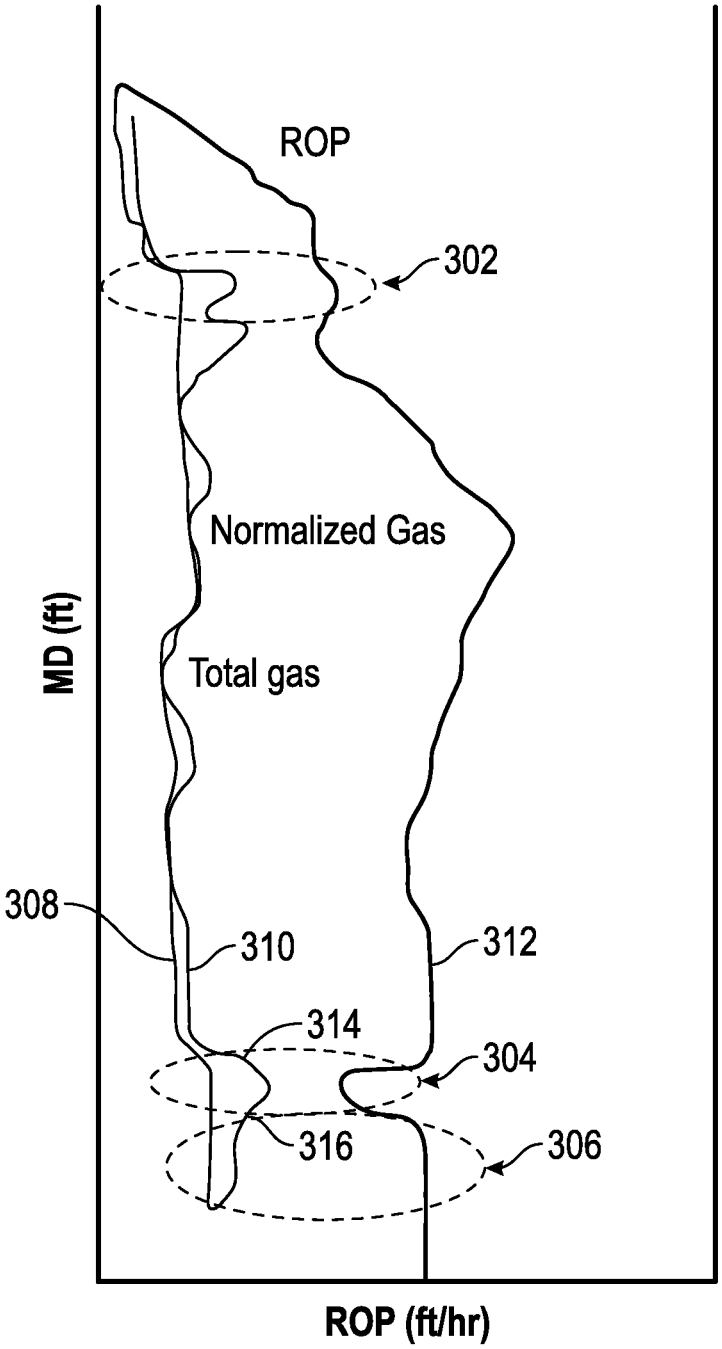
FIG. 3 shows a diagram illustrating the relation between normalized gas, ROP, and total gas for formations of varying lithology in embodiments in accordance with the present disclosure.

FIG. 3 shows a diagram illustrating the relation between normalized gas 310, ROP 312, and total gas 308 for formations of varying lithology in embodiments in accordance with the present disclosure. In a permeable lithology, an increasing normalized gas trend 302 indicates a possible underbalanced condition. When experienced in correlation with connection gases, this pattern is an even stronger indicator, especially when the connection gas demonstrates an increasing trend as well.

In scenarios 304 and 306, the total gas 308 remains relatively constant, but the normalized gas 310 can increase (314) or decrease (316) with respect to ROP 312. When interpreted with ROP related scenarios 304 and 306, the other reported connection gases are not meaningful in terms of overpressure detection, which reinforces the unreliability of connection gases in particular for overpressure detection in tight lithologies.

Figure 4A:
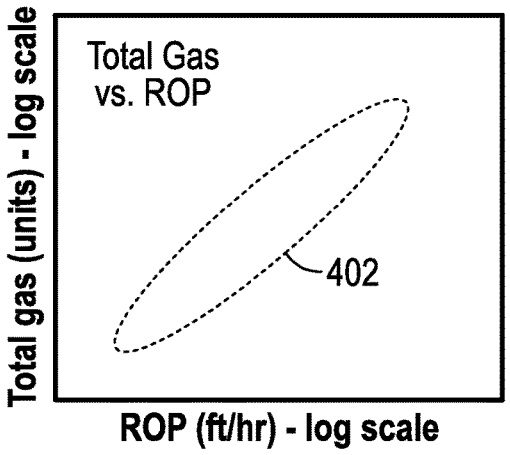
FIGS. 4A and 4B show logarithmic diagrams illustrating example distributions of normalized versus non-normalized gas counts with respect to ROP in embodiments in accordance with the present disclosure.
Figure 4B:
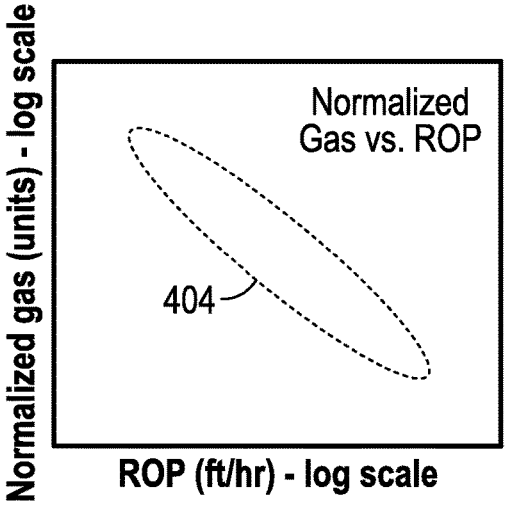

FIGS. 4A and 4B show logarithmic diagrams illustrating example distributions of normalized versus non-normalized gas counts with respect to ROP. Individual data points conform to the cross-plot distributions 402 and 404 shown. Referring to FIG. 4A, the cross-plot 402 between ROP and non-normalized (raw) gas counts indicates the presence of higher total gas counts with increasing ROP. However, in FIG. 4B, the cross-plot 404 between ROP and normalized gas generally indicates higher gas readings with slower ROP, showing that ROP has a significant impact on the recorded gas readings.

It is likely that spending more time drilling a particular section leads to liberation of more gas from these tight (and fractured) low permeability sediments. This is in contradistinction with conventional reservoirs where the presence of a 'drill-break' typically coincides with a high gas peak. Again, an increasing normalized gas trend is not present with increasing ROP. Some tight formations include source rocks (e.g., shale). Thus, a link may be established between hydrocarbon generation and hydrocarbons-in-place. Hydrocarbons-in-place may be influenced by history, Total Organic Content ('TOC'), and thermal maturity of the rock.

Figure 5A:
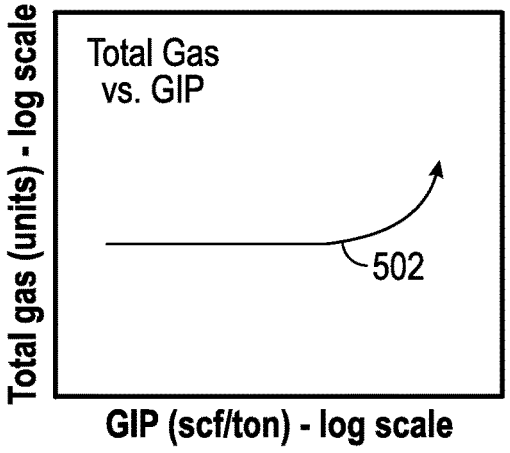
FIGS. 5A and 5B show logarithmic diagrams illustrating the relation of normalized versus non-normalized gas counts with respect to gas-in-place in embodiments in accordance with the present disclosure.
Figure 5B:
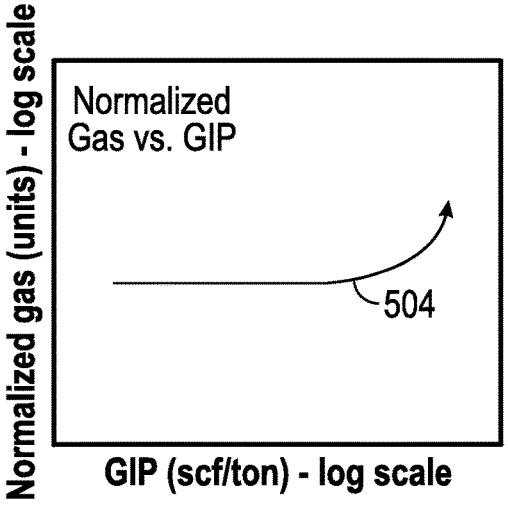

FIGS. 5A and 5B show logarithmic diagrams illustrating the relation of normalized versus non-normalized gas counts with respect to gas-in-place ('GIP'). In both figures, the cross-plot 502 between gas counts and GIP indicates the presence of higher gas counts with increasing GIP.

Figure 6:
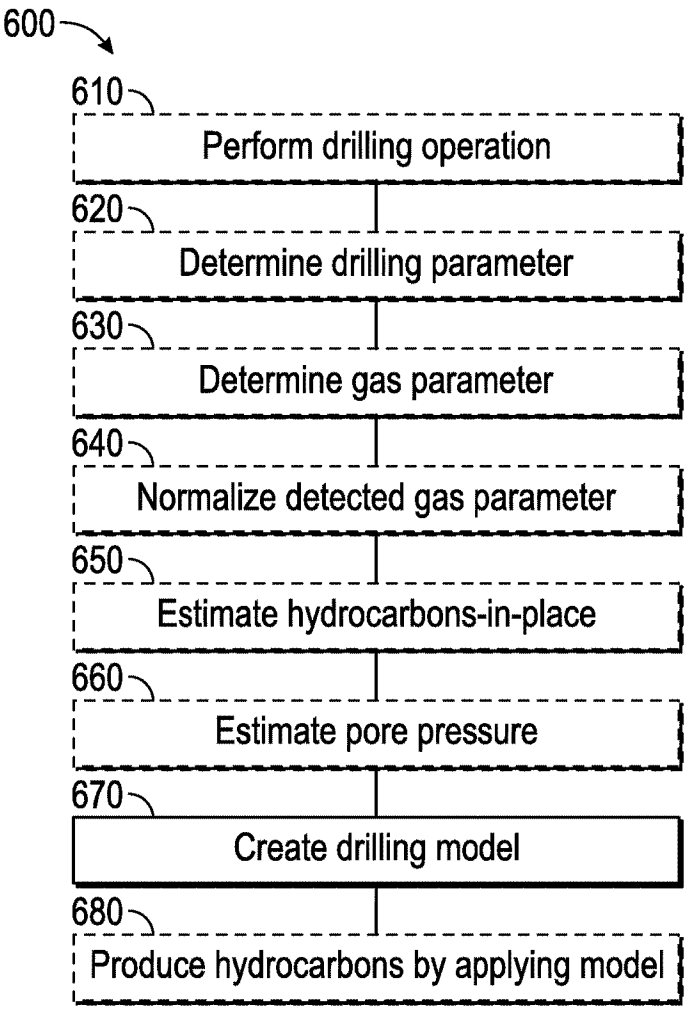
FIG. 6 illustrates a method for modeling a tight hydrocarbon reservoir intersected by a borehole in embodiments in accordance with the present disclosure.

FIG. 6 illustrates a method for modeling a tight hydrocarbon reservoir intersected by a borehole. Optional step 610 of the method 600 may include performing a drilling operation in a borehole. For example, a drill string may be used to form (e.g., drill) the borehole. Optional step 620 of the method 600 may include determining a drilling parameter, such as, for example, by using measurements from sensors associated with the drill string. Optionally, at step 630, the method may include determining a gas parameter, such as rate of gas production (e.g., gas counts) or pressure, from gas information detected using a sensor associated with the borehole during drilling. This gas parameter may be referred to as a detected gas parameter.

Optional step 640 may include normalizing the detected gas parameter. The gas parameter may be normalized using one or more drilling parameters such as actual rate of penetration, a reference rate of penetration, actual hole diameter, reference bit diameter, actual pump rate, reference pump rate, gas system efficiency, and the like. The detected gas parameter may be normalized using the formula:

$$GN=G\cdot(ROPN/ROP)\cdot(DN/D)^2\cdot(Q/QN)\cdot(1/E),$$

where GN is normalized gas units, G is measured gas units, ROPN is reference rate of penetration, ROP is actual rate of penetration, DN is reference bit diameter, D is actual hole diameter, QN is reference pump rate, Q is actual pump rate, and E is gas system efficiency. Gas system efficiency may be assumed to be 1.

Optional step 650 may include estimating hydrocarbons-in-place for the formation. Hydrocarbons-in-place may be estimated using lithology, comparison to analogous formations (e.g., evolution of sediment), or from petrophysical analysis. The normalized gas from a pilot hole or other borehole in the formation could be used to estimate the hydrocarbons-in-place along the horizontal section if suitable petrophysical data is lacking, as described below with reference to FIG. 7.

Petrophysical analysis may include quantifying volumes of free gas and adsorbed gas. An additional category of absorbed gas may also be present, where the gas is dissolved in a liquid (e.g., oil, water) within the pore structure of the formation. In some instances, absorbed gas may be included with the adsorbed gas estimation.

Adsorbed gas is gas that is chemically or physically bound to the surface of organic material or inorganic minerals. Free gas may be estimated using the same methodologies used for calculating hydrocarbon saturations in conventional reservoirs from log and core data. For example, free gas may be calculated from Archie's equation for water saturation using deep resistivity and total porosity measurements.

Adsorbed gas may be determined from core analysis, such as adsorption analysis, desorption analysis, core TOC, or combinations of these. Linear relationships between TOC (wt percentage) and the adsorbed gas content (scf/ton) may be developed from the core analyses for specific plays, areas, or individual wells within a play.

Free gas is gas occurring in the inorganic and organic pore and fracture systems. Free gas may be calculated using the formula:

$$F=\phi_t(1-S_w)(Bg)k$$

wherein F represents free gas (bcf per section foot), $\phi_t$ represents total porosity (fraction), $S_w$ represents water saturation (fraction), Bg represents gas formation volume factor (scf/cf), and k represents a conversion factor. This assumes the sample is in the dry gas window. Bg may be found using the following formula:

$$Bg=Z^*(1/379)^*10.73^*(T/P)$$

and Sw may be calculated using $$S_w=[(a^*R_w)/(R_t^*\phi^m)]^{1/n}$$

wherein $R_t$ is formation resistivity (ohm/m), $R_w$ is formation water resistivity (ohm/m), $S_w$ is water saturation (fraction), $\phi$ is total porosity (fraction), m is the cementation exponent, n is the saturation exponent, and a is the tortuosity factor. Parameters may be further adjusted. For example, total porosity may be TOC-corrected using, for example, NMR total porosity. One estimate of $R_w$ can be obtained from the total porosity and resistivity values in non-organic shale intervals. The values m and n may be adjusted using Pickett plots. The underlying assumption that shale behaves as an Archie reservoir notwithstanding, the selection of the shale formation water resistivity may be employed in many reservoirs.

At optional step 660, the method may further include estimating a pore pressure associated with the tight hydrocarbon reservoir using the normalized gas parameter. At step 670, the method includes using the estimated hydrocarbons-in-place value for the tight hydrocarbon reservoir and the normalized gas parameter associated with drilling the borehole to create a drilling model determining an operation of a well control device associated with the borehole.

Step 670 may further include correlating a peak in estimated pore pressure with nominal drilling conditions using the hydrocarbons-in-place value. Step 670 may include correlating drilling parameters and hydrocarbons-in-place (or parameters indicative of hydrocarbons-in-place) with pore pressure. Some embodiments may include determining a correction factor used to adjust the estimated pore pressure. The correction factor may be representative of liberated gas from decomposition of the source rock by the drilling process. In some embodiments, correcting the estimated pore pressure may be carried out by using a normalized gas parameter (or by adjusting the normalized gas parameter using the correction factor) and using traditional models relating the gas parameter to pore pressure. Some embodiments may include adjusting an estimated pore pressure associated with the tight hydrocarbon reservoir using an estimated hydrocarbons-in-place value for the tight hydrocarbon reservoir and a normalized gas parameter associated with drilling the borehole as described above.

Step 670, may also be carried out by using the normalized gas parameter and the hydrocarbons-in-place value to determine the presence of conditions prone to erroneous kick indications. Step 670 may include trend identification. Trends may be identified by comparing a sequence of values for hydrocarbons-in-place or the normalized gas parameter as drilling progresses or over time. For example, a sequence of increasing (or decreasing) values, or an increase (decrease) in change between values, for a threshold number of values may identify a trend. Step 670, may be carried out by correlating a decreasing normalized gas trend or increasing hydrocarbons-in-place trend with an absence of kick; or by correlating an increasing normalized gas trend or decreasing hydrocarbons-in-place trend with a presence of kick.

In optional step 680, hydrocarbons are produced from the tight hydrocarbon reservoir by applying a model created in step 660 to subsequent operations in the borehole, or to operations in another borehole drilled in the same reservoir. At step 680, the method may include determining whether the borehole is in an underbalanced condition using the drilling plan. Step 680 may be carried out using the current hydrocarbons-in-place value and at least one of: i) the current detected gas parameter; ii) the current normalized gas parameter; and iii) the current estimated pore pressure.

Figure 7:
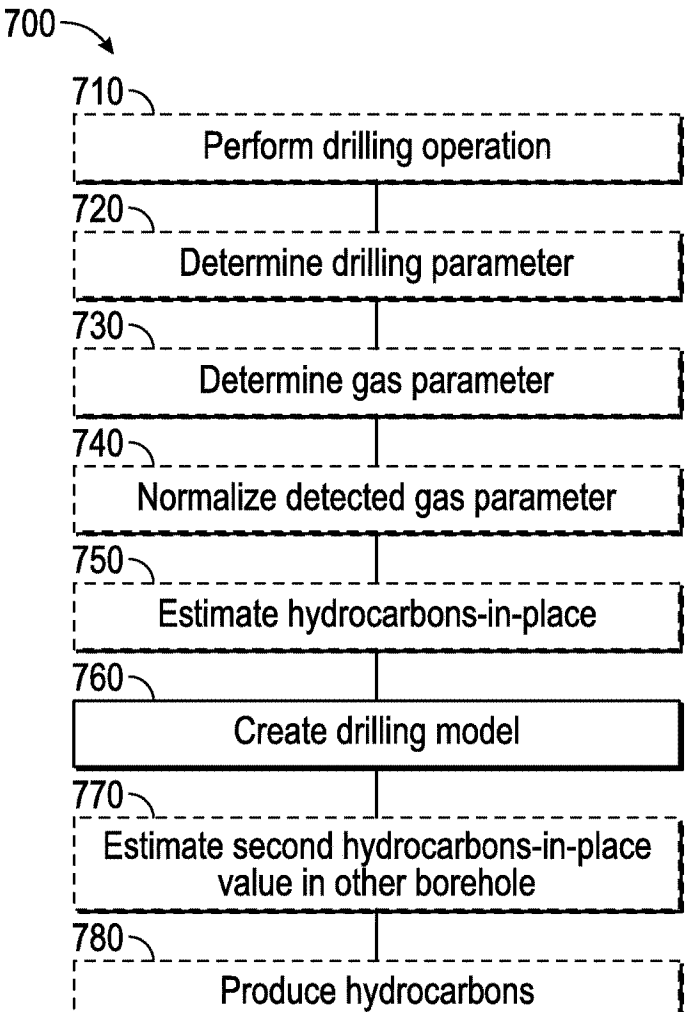
FIG. 7 illustrates another method for modeling a tight hydrocarbon reservoir intersected by a borehole in embodiments in accordance with the present disclosure.

FIG. 7 illustrates another method for modeling a tight hydrocarbon reservoir intersected by a borehole. The borehole may represent an exploratory well, a pilot hole, or other wellbore. Optional step 710 of the method 700 may include performing a drilling operation in a borehole. For example, a drill string may be used to form (e.g., drill) the borehole. Optional step 720 of the method 700 may include determining a drilling parameter, such as, for example, by using measurements from sensors associated with the drill string. Optionally, at step 730, the method may include determining a gas parameter, such as rate of gas production (e.g., gas counts) or pressure, from gas information detected using a sensor associated with the borehole during drilling. This gas parameter may be referred to as a detected gas parameter. Optional step 740 may include normalizing the detected gas parameter, such as, for example, in a manner described above with reference to FIG. 6.

Optional step 750 may include estimating hydrocarbons-in-place for the formation. Hydrocarbons-in-place may be estimated using lithology, comparison to analogous formations (e.g., evolution of sediment), or from petrophysical analysis, as described above. For example, a hydrocarbons-in-place value may be estimated using at least one parameter log for at least one of a geological parameter, a geophysical parameter, a petrophysical parameter, and/or a lithological parameter.

At step 760, the method includes using the estimated hydrocarbons-in-place value for the tight hydrocarbon reservoir and the normalized gas parameter associated with drilling the borehole to create a drilling model correlating the hydrocarbons-in-place value with the gas parameter for the tight hydrocarbon reservoir. This step may be carried out using, for example, interpolation, extrapolation, curve fitting, linear or non-linear regression, least square fit routines, and so on. These values may be further correlated with location in the formation.

Optional step 770 may include using the model to estimate a second hydrocarbons-in-place value in another borehole intersecting the tight hydrocarbon reservoir. For example, a deviated borehole may lack suitable log data to make a conventional estimation of hydrocarbons-in-place. Accurate estimations of hydrocarbons-in-place in an interval of the other borehole may be obtained using the model and a second normalized gas parameter value from the other borehole. In optional step 780, hydrocarbons are produced from the tight hydrocarbon reservoir by applying the model to subsequent operations (e.g., drilling) in the other borehole in the same reservoir. In particular embodiments, the estimated hydrocarbons-in-place value may be used in further modeling of the tight hydrocarbon reservoir or the formation. Additional models resulting from these techniques may also be used in conducting operations in further boreholes relating to the tight hydrocarbon reservoir. For example, the estimated hydrocarbons-in-place value may be used to define a completion methodology for the borehole (or formation), such as the selection of zones for fracturing.

In some instances, information from multiple boreholes may be combined in modeling the tight hydrocarbon formation for use in a further borehole. The term "conveyance device" or "carrier" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, and self-propelled tractors. The term "information" as used above includes any form of information (analog, digital, EM, printed, etc.). The term "processor" herein includes, but is not limited to, any device that transmits, receives, manipulates, converts, calculates, modulates, transposes, carries, stores or otherwise utilizes information. An information processing device may include a processor, resident memory, and peripherals for executing programmed instructions.

"Tight hydrocarbon reservoir," as used herein, means a reservoir in an earth formation having a permeability of less than 1 millidarcy. "Source rock," as used herein, means a rock (e.g., shale, limestone) rich in organic matter which may generate oil or gas. Rich in organic matter may mean 0.5 percent organic matter, 1 percent organic matter, 2 percent organic matter, 3 percent organic matter, 5 percent organic matter, or higher. A characterization of source rock and reservoir rock may not always be mutually exclusive. "Untriggered" refers to an intentional non-activated state arrived at through the determination that triggering conditions are not met. Nominal drilling conditions may refer to conditions where no kick is present or eminent.

While the present disclosure is discussed in the context of a hydrocarbon producing well, it should be understood that the present disclosure may be used in any borehole environment (e.g., a water or geothermal well).

The present disclosure is susceptible to embodiments of different forms. There are shown in the drawings, and herein are described in detail, specific embodiments of the present disclosure with the understanding that the present disclosure is to be considered an exemplification of the principles of the disclosure and is not intended to limit the disclosure to that illustrated and described herein. While the foregoing disclosure is directed to the one mode embodiments of the disclosure, various modifications will be apparent to those skilled in the art. It is intended that all variations be embraced by the foregoing disclosure.

We claim:

1. A method for modeling a tight hydrocarbon reservoir intersected by a borehole, the method comprising:

using a drilling system to form a borehole intersecting the tight hydrocarbon reservoir by drilling the reservoir, the drilling including rotating a drill bit of the drilling system to disintegrate the tight hydrocarbon reservoir and thereby producing gas comprising gas released from pore space within rock of the formation and liberated gas released from source rock of the formation via disintegration;

using an estimated hydrocarbons-in-place value for the tight hydrocarbon reservoir and a gas parameter associated with drilling the borehole to create a drilling model, wherein the gas parameter comprises a detected gas parameter normalized using at least one corresponding drilling parameter of the drilling to account for the liberated gas released from source rock of the formation via disintegration, the detected gas parameter determined from gas information detected during the drilling using a sensor associated with the drilling system.

2. The method of claim 1, wherein the drilling model determines an operation of a well control device associated with the borehole.

3. The method of claim 2 further comprising:

operating the well control device according to the drilling model.

4. The method of claim 1, wherein the drilling model determines the presence of an underbalanced condition of the borehole in dependence upon a current hydrocarbons-in-place value and a current gas parameter.

5. The method of claim 1, further comprising estimating a pore pressure associated with the tight hydrocarbon reservoir using the gas parameter.

6. The method of claim 5 wherein the drilling model determines the presence of an underbalanced condition of the borehole in dependence upon a current hydrocarbons-in-place value and at least one of: i) the gas parameter; and ii) the estimated pore pressure.

7. The method of claim 5 further comprising correlating a peak in the detected gas parameter with nominal drilling conditions using the hydrocarbons-in-place value.

8. The method of claim 1 wherein the gas parameter comprises the detected gas parameter normalized using at least one of: i) rate of penetration; ii) bit diameter; iii) borehole diameter; and iv) pump rate.

9. The method of claim 8 wherein the gas parameter comprises the detected gas parameter normalized using the formula:

$$GN=G\cdot(ROP_N/ROP)\cdot(D_N/D)^2\cdot(Q/Q_N)\cdot(1/E),$$

where $G_N$ is normalized gas units, G is measured gas units, $ROP_N$ is reference rate of penetration, ROP is actual rate of penetration, $D_N$ is reference bit diameter, D is actual hole diameter, $Q_N$ is reference pump rate, Q is actual pump rate, and E is gas system efficiency.

10. The method of claim 1 wherein the detected gas parameter comprises a parameter in a wellbore during drilling, the parameter comprising at least one of i) a rate of gas production; and ii) a gas pressure.

11. The method of claim 1 further comprising estimating hydrocarbons-in-place.

12. The method of claim 1 further comprising normalizing the detected gas parameter using the drilling parameter.

13. The method of claim 1 further comprising deriving the estimated hydrocarbons-in-place using the gas parameter.

14. The method of claim 1 further comprising:

correlating an absence of kick with at least one of: i) a decreasing normalized gas trend or ii) an increasing hydrocarbons-in-place trend.

15. The method of claim 1 further comprising:

correlating kick with at least one of: i) an increasing normalized gas trend or ii) a decreasing hydrocarbons-in-place trend.

16. The method of claim 1, wherein the model correlates the hydrocarbons-in-place value with the gas parameter for the tight hydrocarbon reservoir.

17. A method for producing a hydrocarbon from a tight hydrocarbon reservoir, the method comprising:

forming a borehole intersecting the tight hydrocarbon reservoir by drilling the reservoir, the drilling including rotating a drill bit of the drilling system to disintegrate the tight hydrocarbon reservoir and thereby producing gas comprising gas released from pore space within rock of the formation and liberated gas released from source rock of the formation via disintegration;

determining, in real-time during the forming of the borehole, an operation of a well control device associated with the borehole using an estimated hydrocarbons-in-place for the tight hydrocarbon reservoir and a gas parameter, the gas parameter comprising a detected gas parameter normalized using a drilling parameter associated with the drilling operation to account for the liberated gas released from source rock of the formation via disintegration; and operating the well control device according to the determination.

18. The method of claim 17 further comprising using the estimated hydrocarbons-in-place value and the gas parameter to determine the mud weight.

19. The method of claim 17 wherein operating the well control device comprises leaving the well control device untriggered.

20. A method for producing hydrocarbons from a tight hydrocarbon reservoir, the method comprising:

employing a drilling model created using the method of claim 1 to perform operations in another borehole drilled in the same reservoir.

21. The method of claim 20 wherein the model correlates the hydrocarbons-in-place value with the gas parameter for the tight hydrocarbon reservoir, the method further comprising using the model to estimate a second hydrocarbons-in-place value in the another borehole.

22. The method of claim 20 further comprising creating the drilling model using the method of claim 1.

* * * * *